United States Patent [19]

Arendt et al.

[11] 4,432,501

[45] Feb. 21, 1984

[54] APPARATUS FOR THE CONTINUOUS PRODUCTION AND LAYING DOWN OF YARN LOOPS

[75] Inventors: Gerhard Arendt, Hohentengen; Roland Benz, Denkendorf; Reinhold Engenhart, Blochingen; Viktor Schmidt, Saulgau, all of Fed. Rep. of Germany

[73] Assignee: Lucke Apparate-Bau GmbH, Mengen, Fed. Rep. of Germany

[21] Appl. No.: 365,998

[22] Filed: Apr. 6, 1982

[30] Foreign Application Priority Data

Apr. 10, 1981 [DE] Fed. Rep. of Germany ..... 3114535

[51] Int. Cl.[3] ..... B65H 54/76

[52] U.S. Cl. ..... 242/47; 28/289; 226/118; 242/82; 242/53

[58] Field of Search ..... 226/200, 118, 113, 1; 242/47, 53, 54 A, 82, 83, 1, 47.01, 25 R; 28/289, 101; 66/84 A

[56] References Cited

U.S. PATENT DOCUMENTS

| | | | |
|---|---|---|---|
| 3,120,689 | 2/1964 | Drummond | 28/289 X |
| 3,332,126 | 7/1967 | Cabello | 28/289 X |
| 3,369,280 | 2/1968 | Shattuck et al. | 242/47 |
| 3,430,312 | 3/1969 | Drummond | 28/289 |

*Primary Examiner*—Stanley N. Gilreath
*Attorney, Agent, or Firm*—Shenier & O'Connor

[57] ABSTRACT

The invention relates to an apparatus for the continuous production and laying down of yarn loops, in which the yarn loops are introduced onto a lap body by a revolving lap flyer and are transferred from the lap body onto a belt conveyor. To ensure yarn is laid down onto the belt conveyor without stretching, so that it can be drawn off again from above from the conveyor without obstruction, the lap body is a rotationally symmetrical body rotating about its axis of symmetry, the axis of rotation of the lap body extends transversely both to the axis of rotation of the lap flyer and to the running direction of the belt conveyor, and the lap body is driven so that its direction of rotation where it faces the belt conveyor is the same as the running direction of the conveyor.

6 Claims, 6 Drawing Figures

Fig. 3
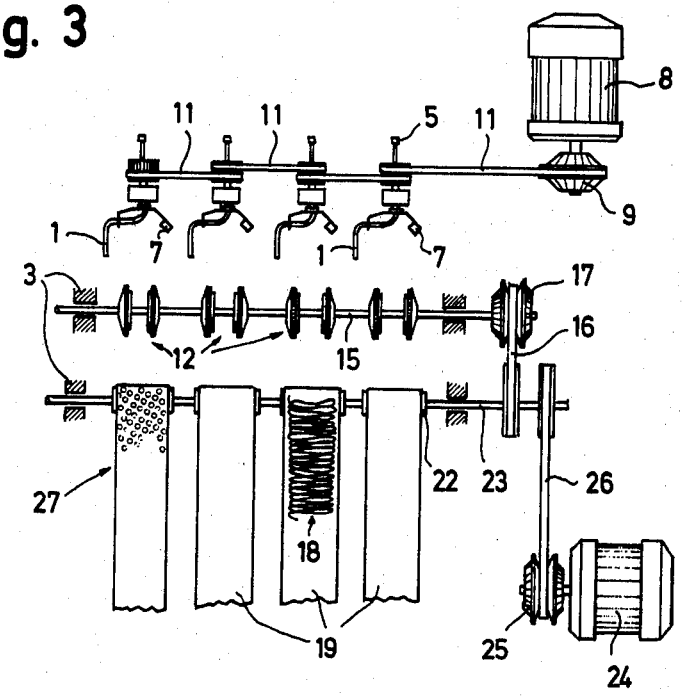
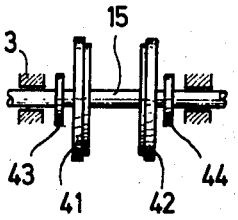
Fig. 4
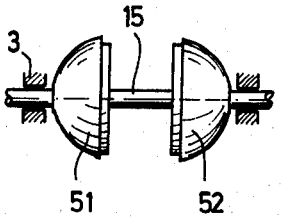
Fig. 5
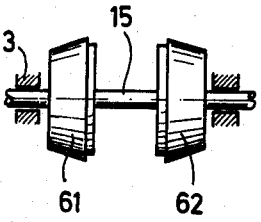
Fig. 6

APPARATUS FOR THE CONTINUOUS PRODUCTION AND LAYING DOWN OF YARN LOOPS

This invention relates to an apparatus for the continuous production and laying down of yarn loops, in which the yarn loops are introduced by a revolving lap flyer onto a lap body and are transferred from that body onto a belt conveyor.

In a known apparatus of this kind, described in DE-OS No. 2,828,535, several screw spindles arranged in the form of a ring are provided as lap bodies. The winding flyer introduces the yarn in the form of a virtually closed coil or loop into the particular topmost thread of the screw spindles, whereupon the loop is transported by the rotating screw spindles into the lowermost screw thread. From there, the loops fall, in succession and overlapping one another, onto an advancing conveyor belt which transports them to a take-off position.

The known apparatus has two disadvantages: first the yarn is stretched by the screw spindles; when two yarns are processed simultaneously, this leads to the difficulty that the two yarns become caught in one another and impede further treatment.

Secondly, it is necessary, in the known apparatus, to turn the loops through 180° after they have dropped from the lower ends of the screw spindles, otherwise, when the yarn is drawn off, it has to be drawn forwardly under loops located above it, and this can easily lead to yarn entanglement.

A main object of the invention is, therefore, to propose an apparatus for the continuous production and laying down of yarn loops in which a yarn can be laid down on a belt conveyor, without substantial stretching, in such a way that the yarn can be taken off the conveyor from above without obstruction.

BRIEF SUMMARY OF THE INVENTION

The invention provides apparatus for the continuous production and laying down of yarn loops, in which the yarn loops are introduced by a revolving lap flyer onto a lap body and are transferred from the lap body onto a belt conveyor, wherein the lap body is a rotationally symmetrical body rotating about its axis of symmetry, the axis of rotation of the lap body extends transversely both to the axis of rotation of the lap flyer and to the running direction of the belt conveyor, and the lap body is so driven that its direction of rotation where it faces the belt conveyor, is the same as the running direction of the belt conveyor.

BRIEF DESCRIPTION OF THE DRAWINGS

Some embodiments of the invention will now be described, by way of example, with reference to the accompanying drawings in which:

FIG. 3 shows the arrangement in series of several apparatus illustrated in FIGS. 1 and 2, together with an associated drive, and FIGS. 4, 5 and 6 show possible embodiments of lap bodies.

DETAILED DESCRIPTION

Figure 1:
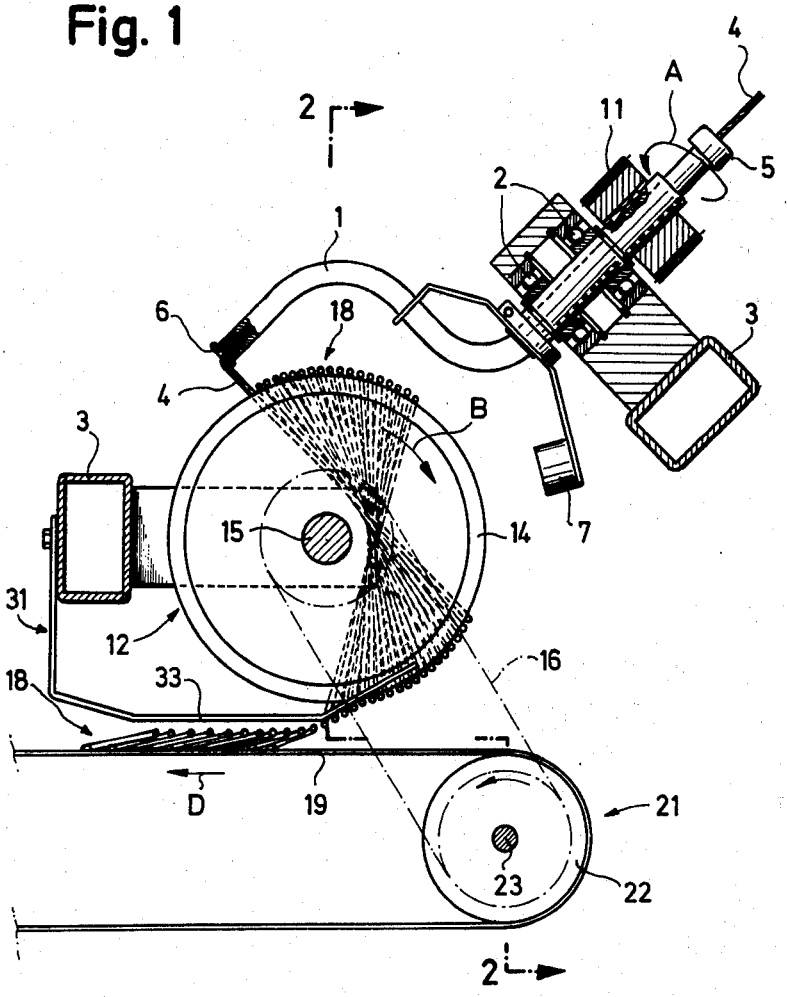
FIG. 1 is a side view of an apparatus according to the invention for the continuous production and laying down of yarn loops.
Figure 2:
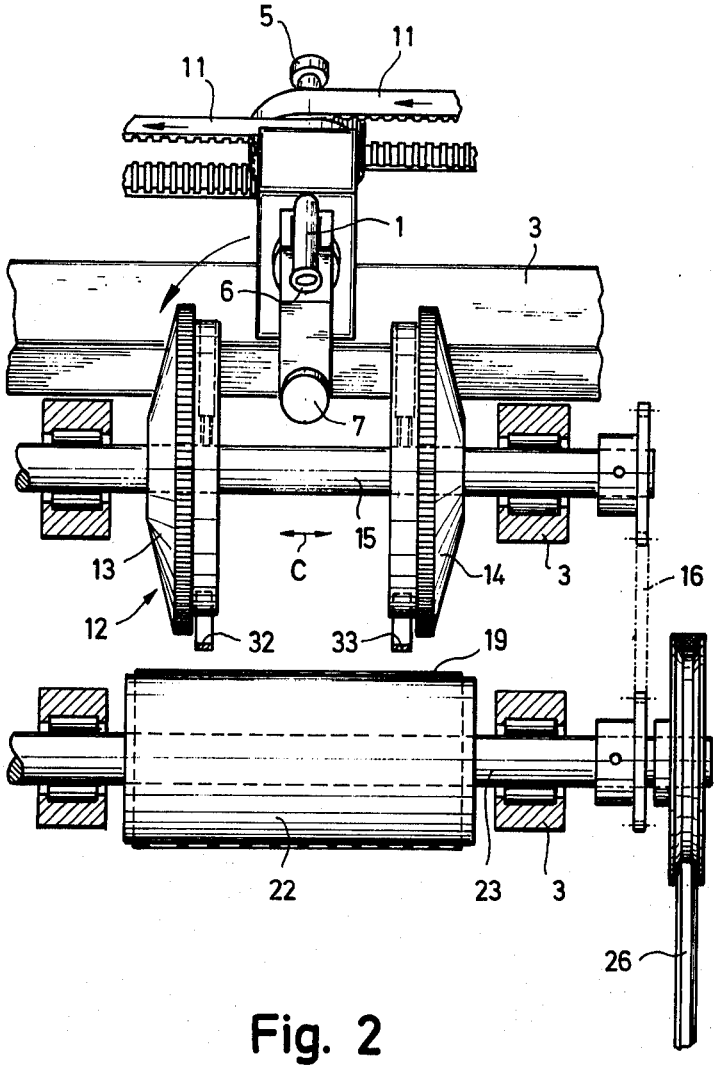
FIG. 2 is a partially sectional front view on the line 2—2 of FIG. 1.

Referring to FIGS. 1 and 2, a conventional lap flyer 1 is mounted rotatably by means of roller bearings 2 on a machine frame 3. The direction of rotation is indicated by the arrow A. The lap flyer 1 has the form of a multiple curved tube. A yarn 4 to be laid down in loops is introduced into the lap flyer 1 at the rearward end 5 and runs out from the front end 6 which revolves in a circular orbit. A counterweight 7 balances the rotating lap flyer 1. The lap flyer is driven by a motor 8, FIG. 3, through an infinitely variable gearbox 9 by toothed belts 11.

A lap body 12 which is rotatably driven is located in the region of rotation of the front outlet end 6 of the lap flyer 1. The direction of rotation of the lap body 12 is indicated by the arrow B. In the embodiment illustrated, the lap body comprises two disc-like loop carriers 13, 14 which are mounted adjustably on a rotatably mounted shaft 15 in such a way that their distance apart is adjustable in the direction of the double arrow C, FIG. 2, within the region of rotation of the lap flyer 1 in order to vary the size or diameter of the loops formed on the loop carriers. The shaft 15 is rotatably mounted in the machine frame 3 and is driven by a toothed belt 16, from an infinitely variable gearbox 17, FIG. 3. In the edge region of the loop carriers 13, 14, the surface of the lap body is roughened, e.g. knurled in the present embodiment, so that the yarn loops introduced onto the lap body cannot readily slip off.

As shown particularly in FIG. 1, when the lap flyer 1 rotates and the lap body 12 rotates, yarn loops 18 are continuously laid next to one another on the lap body. When the lap body 12 rotates in the direction of the arrow B, the loops 18 formed are laid down, in succession and partially overlapping one another, onto a conveyor belt 19, which advances in the direction of the arrow D, of a driven belt conveyor 21. During this process, the loops are turned through approximately 90° between being laid onto the lap body 12 and being transferred onto the belt conveyor 21, so that the yarn 4 can always be drawn off again from above on the other end of the belt conveyor 21, not shown in any more detail in FIG. 1, without being impeded by any loops located above it. Consequently, when the yarn is drawn off, the configuration of the loops lying on the conveyor belt 19 cannot be disturbed, and no undesirable entanglement of the yarn 4 occurs. If the lap body 12 were to rotate in a direction opposite to the arrow B, then the yarn would have to be drawn forward from below from loops located above it, which can lead to undesirable yarn entanglement.

The belt conveyor 21 comprises, in a conventional way, two rollers, of which only the roller 22 adjacent to the lap body 12 is shown in the drawing. The roller 22 is mounted on a shaft 23 which is driven by a motor 24 through an infinitely variable gearbox 25 via a toothed belt 26. The shaft 15 carrying the lap body 12 is also driven from the shaft 23, as illustrated in FIG. 3. The conveyor belt 19 is perforated, as indicated in FIG. 3 at 27, so that yarn lying on the conveyor belt in the form of loose loops or coils 18 can also be treated from below with hot steam or the like.

As shown in FIG. 3, it is advantageous to arrange next to one another in series several units, each consisting of a lap flyer 1, a lap body 12 and a conveyor belt 19. As a result of the variable gears 9, 17 and 25, the speeds of rotation of the lap flyer 1, lap body 12 and belt conveyor 12 are each adjustable individually. All the units, each consisting of a lap flyer 1, lap body 12 and conveyor belt 9, are driven together by the motors 8 and 24. In another embodiment there may be individual drives to each of the units, so that they can each be individually operated at different speeds or individually stopped.

As is clear from the drawings, it is important, for perfect loop formation and transfer of the loops onto the belt conveyor 21, that the axis of rotation of the lap body 12 extends transversely both to the axis of rotation of the lap flyer 1 and to the running direction D of the conveyor belt 19. The lap body is therefore driven in the direction of the arrow B in such a way that its direction of rotation coincides, on its side facing the conveyor belt 19, with the running direction D of the belt. It is especially advantageous if the axis of rotation of the lap body 12 is perpendicular to the axis of rotation of the lap flyer 1 and to the running direction D of the belt conveyor 21.

The lap body 12 itself is a rotationally symmetrical body rotating about its axis of symmetry. In the embodiment according to FIGS. 1 and 2, it consists of the two separate loop carriers 13, 14. In the embodiment of FIG. 4, disc-shaped auxiliary carriers 43, 44 are assigned to the two disc-shaped loop carriers 41, 42 to ensure that the loops are properly formed on the main elements 41 and 42. In FIG. 5, hemispheres 51, 52 are arranged as loop carriers on the shaft 15. Instead of hemispheres, spherical structures can also be provided. FIG. 6 shows an embodiment in which the loop carriers take the form of truncated cones 61 and 62. The distance between the loop carriers in FIGS. 4, 5 and 6 can also be adjustable. The surface of these loop carriers can be roughened, for example toothed or knurled, for better retention of the yarn loops. Instead of using two separate loop carriers, a rotationally symmetrical body of revolution closed on itself, for example an ellipsoid of revolution, can be used.

To guarantee safe transfer onto the conveyor belt 19 of the yarn coils or loops 18 formed on the lap body 12 by the lap flyer 1, it is advantageous to provide a loop stripper 31. As shown in FIGS. 1 and 2, the loop stripper 31 consists of two metal bows 32, 33 which are bent approximately at right angles and which are fastened to one end to the machine frame 3. Their free ends project obliquely upwards from below into the lap body 12 into an annular step formed on each loop carrier in the preferred arrangement illustrated. In this way, the loops are reliably stripped from the lap body 12 and laid on the conveyor belt 19.

The essential advantage of the invention in comparison with the known apparatus mentioned in the introduction, is that the lap body 12 which initially carries the loops also serves, at the same time, to turn over the loops 18 in such a way that the yarn 4 forming the loops can be drawn off again from above at the opposite end of the belt conveyor 21, without the yarn being entangled at the same time.

As shown in FIG. 1, the yarn loops 18 are each formed by the lap flyer 1 in the region located between the axis of rotation of the lap body 12 on its shaft 15, and the pivot bearing 2 of the lap flyer 1, and are subsequently transferred to the belt conveyor 21 while being turned through approximately 90°.

We claim:

1. Apparatus for the continuous production and laying down of yarn loops including in combination a rotationally symmetrical lap body comprising a shaft, a pair of loop carriers and means adjustably mounting said carriers in spaced relationship on said shaft, means mounting said shaft for rotary movement around a first axis corresponding to the axis of symmetry of said body, a belt conveyor for receiving loops from said body, means mounting said conveyor for movement of the loop receiving length thereof in a certain direction, a lap flyer for introducing yarn loops onto said lap body, means mounting said lap flyer for rotary movement around a second axis, the arrangement being such that said first axis extends transversely both to said second axis and said certain direction, means for driving said lap body so that the portion thereof adjacent to said conveyor moves generally in said certain direction, and a stationary loop stripper extending into the space between the loop carriers for transferring loops from said lap body to said belt conveyor.

2. Apparatus as in claim 1 including a plurality of units, each of said units including a lap flyer and a lap body and a belt conveyor having said arrangement, said units being disposed adjacent to each other, a first common drive motor for the lap flyers of said units and a second common drive motor for the lap bodies and belt conveyors of said units.

3. Apparatus according to claim 1, wherein the loop carriers are discs.

4. Apparatus according to claim 1, wherein the loop carriers are hemispheres.

5. Apparatus according to claim 1, wherein the loop carriers are truncated cones.

6. Apparatus according to claim 1, wherein the surface of the lap body is at least partially roughened, by being knurled or toothed.

* * * * *